US006191377B1

(12) United States Patent
Roesner et al.

(10) Patent No.: US 6,191,377 B1
(45) Date of Patent: Feb. 20, 2001

(54) ELECTROMAGNETIC SWITCHING DEVICE WITH ARCING CHAMBERS

(75) Inventors: Norbert Roesner, St. Augustin; Jakob Bolz, Bonn; Helmut Kern, Troisdorf, all of (DE)

(73) Assignee: Moeller GmbH, Bonn (DE)

( * ) Notice: Under 35 U.S.C. 154(b), the term of this patent shall be extended for 0 days.

(21) Appl. No.: 09/424,734

(22) PCT Filed: Mar. 20, 1999

(86) PCT No.: PCT/EP99/01875

§ 371 Date: Nov. 30, 1999

§ 102(e) Date: Nov. 30, 1999

(87) PCT Pub. No.: WO99/50867

PCT Pub. Date: Oct. 7, 1999

(30) Foreign Application Priority Data

Mar. 31, 1998 (DE) ..... 198 14 411

(51) Int. Cl.[7] ..... H01H 33/02

(52) U.S. Cl. ..... 218/149; 218/151; 335/201

(58) Field of Search ..... 335/8–10, 132, 335/201, 202; 200/295–308; 218/34, 37, 149, 151, 154, 155, 156, 157

(56) References Cited

U.S. PATENT DOCUMENTS

| | | | | |
|---|---|---|---|---|
| 3,873,797 | * | 3/1975 | Hannich | 200/308 |
| 4,011,425 | * | 3/1977 | Gryctko | 218/22 |
| 4,254,316 | * | 3/1981 | Landow | 200/308 |
| 4,506,243 | * | 3/1985 | Okako et al. | 335/132 |
| 4,684,772 | | 8/1987 | Lehman . | |
| 4,945,327 | | 7/1990 | Siemens . | |
| 5,635,886 | * | 6/1997 | Pichard | 335/132 |

FOREIGN PATENT DOCUMENTS

| | | |
|---|---|---|
| 11 96 750 | 7/1965 | (DE) . |
| 73 27 820 | 11/1973 | (DE) . |
| 85 31 352 | 1/1986 | (DE) . |
| 85 31 354 | 1/1986 | (DE) . |
| 0 505 794 | 9/1992 | (EP) . |

* cited by examiner

*Primary Examiner*—Lincoln Donovan
*Assistant Examiner*—Tuyên Nguyên
(74) *Attorney, Agent, or Firm*—Kenyon & Kenyon

(57) ABSTRACT

An electromagnetic switching device, in particular a high capacity contactor, includes switch contacts which are arranged inside interrupter chambers formed by an interrupter chamber housing. Also provided is a deionizing device which is in the form of an arcing chamber and assigned to each interrupter chamber with a switch contact. The arcing chamber is formed by arcing plates which are assembled to form a packet. In addition, a cover is provided for closing the interrupter chambers on the upper side. The uppermost arcing plate which faces the cover is configured as a shielding plate of each arcing chamber and has at least one upward bent clip. Recesses which correspond with the clips of the arcing chambers are formed on the underside of the cover. The arcing chambers can be fastened to the cover to provide an interlocking connection by plugging the clips into the recesses.

13 Claims, 2 Drawing Sheets

ELECTROMAGNETIC SWITCHING DEVICE WITH ARCING CHAMBERS

FIELD OF THE INVENTION

The present invention relates in general to an electromagnetic switching device, and in particular, to a high-capacity contactor, having switch contacts which are arranged within interrupter chambers formed in an interrupter housing, and having a de-ionization device in the form of an arcing chamber assigned to each interrupter chamber having a switch contact.

RELATED TECHNOLOGY

An electromagnetic switching device having an arcing plate arrangement, which is mounted in a housing that has a removable cover is known from German Utility Model No. 85 31 352 U1, for example, where the arcing plates are inserted in grooves in the housing walls and held fast using comb-shaped rubber parts when the cover is installed, with each packet of arcing plates forming an arcing chamber. European Patent Document No. 0505 794 B1 describes an electromagnetic switching device having a multipart housing, in which switch contacts are mounted in the interrupter chambers of a housing part enclosing an interrupter chamber and each switch contact has a de-ionization device in the form of an arcing chamber having arcing plates and a commutating plate, the arcing plates forming the arcing chamber being clamped in the housing that encloses the interrupter chambers using the commutating plate. ('German Patent Document Offenlegungsschrift') No. 11 96 750 describes an electric switching device in which the arcing plates forming the arcing chamber are individually held in the top portion of the housing wall covering the interrupter chamber.

SUMMARY OF THE INVENTION

An object of the present invention is to provide an electromagnetic switching device with simplified fastening of the arcing chambers, formed by arcing plates, in the switching device, i.e., in the housing enclosing the interrupter chambers, and having simpler and more reliable assembly without additional separate parts for fastening the arcing chambers in the space provided.

The present invention provides an electromagnetic switching device, in particular a high-capacity contactor, including an interrupter chamber housing with six interrupter chambers opening in an upward direction. A cover is provided for enclosing the topside of the interrupter chambers. A respective interrupter contact is disposed in each interrupter chamber. A respective arcing chamber associated with each interrupter chamber is provided. Each arcing chamber includes a plurality of arcing plates arranged so as to form a packet. The uppermost arcing plate, working as a shield plate of each arcing chamber has at least one clip bent upward and recesses corresponding to the clips of the arcing chambers are formed on the underside of the cover, and the arcing chambers can be fastened to the cover by inserting the clips in the recesses, forming a positive-locking joint. The arcing chambers are fastened to the underside of the cover of the interrupter chambers according to the present invention without additional means, clamping parts, springs or the like. Pre-manufacturing of the arcing chamber as a module made up of arcing plates is made possible according to the present invention, and this arcing chamber can then be joined to the cover in an additional assembly operation. The cover can then be mounted on the switching device, i.e., the interrupter chamber, together with the arcing chambers in order to close the switching device. The present invention allows the pre-manufactured arcing chambers to be mounted on the cover accurately and quickly, avoiding short-circuits, seizing or damage during subsequent assembly operations.

According to an exemplary embodiment of the present invention, a pair of clips is formed on the opposite sides and approximately in the center of the uppermost arcing plate acting as a shield plate of an arcing chamber, and projecting essentially at a right angle to the plane of the arcing plates. A pair of corresponding recesses is formed for each arcing chamber to be attached on the underside of the cover.

In order to allow accurate positioning and assembly of the arcing chambers on the cover, it is furthermore proposed that the clips have an insertion groove used to insert and guide the clip via a corresponding central ridge across the recess, formed on the underside of the cover.

The clips have a fork-shaped design according to the present invention, so that their two tines can elastically bend in each direction. In an embodiment of the present invention, the clips may have a serration on their outer edges, so that when they are inserted in the recess of the cover, they can be inserted with a slight clamping action and there is also space for yielding in the groove area.

In order to achieve secure guidance and fastening in the recess even in the direction across the outer edges of the clips, in an embodiment of the present invention both sides of the recesses have projecting insertion wedges adjacent to one side of the central ridge for the insertion and elastic fastening of the clips in the arcing chamber. This makes it possible to easily insert both clips of a clip pair parallel to one another and turned toward one another in the case, for example, of insertion wedges mounted on opposite external sides of two corresponding recesses, and thus to achieve a flexible clamping effect for secure fastening of the clips and thus of the arcing chamber to the cover.

In order to allow good pressure relief and venting of gases from the arcing chamber, the uppermost arcing plate acting as a shield plate is perforated, at least in certain areas. Thus gases can escape, but particles are retained. The front edge of the shield plate is preferably bent upward and provided with holes, thus forming a venting path.

Furthermore it is proposed that the shield plate be provided with a screw block in its area opposite the upward bend in order to allow the arcing chamber to be screwed to the bottom of the cover if needed in addition to the positive-locking fastening and positioning.

For this purpose, the cover has a threaded hole on the underside to accommodate a screw. This arrangement according to the present invention is also characterized by the fact that in each of two symmetrical rows there are three areas to accommodate arcing chambers on the underside of the cover, and each of these areas has an opening adjacent to the cover edge in which the bent edge of the shield plate can be inserted.

BRIEF DESCRIPTION OF THE DRAWINGS

The present invention is elucidated below with reference to the drawings, in which.

DETAILED DESCRIPTION

Figure 1:
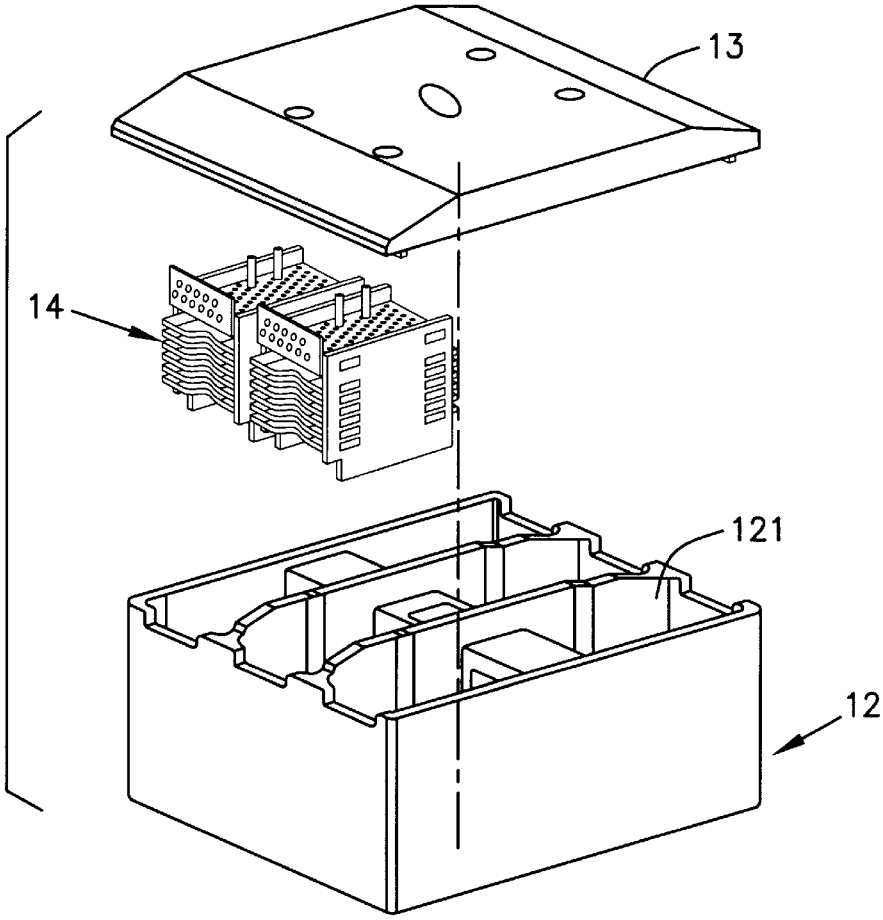
FIG. 1 shows an exploded view of an electromagnetic switching device with the interrupter chamber including the arcing chambers and the cover.

FIG. 1 shows an exemplary interrupter chamber housing 12 of an electromagnetic switching device, which is used to accommodate the interrupter contacts, for which purpose it is subdivided into an appropriate number of separate interrupter chambers 121 by appropriate partition walls. The interrupter chamber housing, and thereby, the interrupter chambers, are covered on the top by cover 13. In the example shown, there are six interrupter chambers in each interrupter chamber housing; an arcing chamber 14 is inserted between the interrupter contact and the cover. In order for the switching device to work properly, each arcing chamber 14 must be accurately positioned; therefore it is fastened in the switching device, according to the present invention, to the underside of cover 13.

Figure 3:
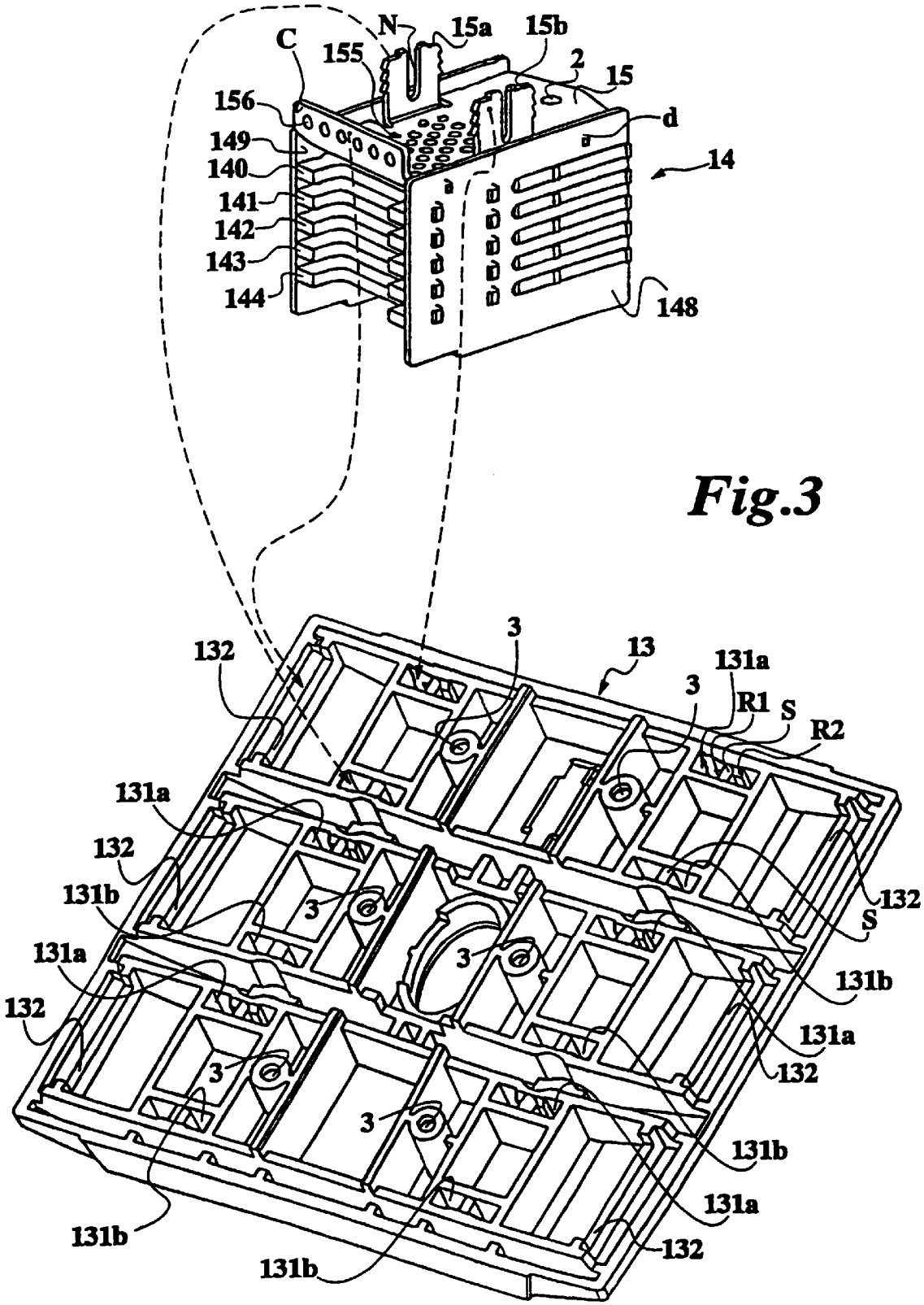
FIG. 3 shows a perspective view of an arcing chamber and the bottom view of the cover with the recesses for fastening the arcing chamber.

Each arcing chamber 14 is, as FIG. 3 shows, formed by parallel arcing plates 140 through 144, which are spaced from one another and are joined by being inserted in the lateral insulating plates 148, 149 to form a packet. The uppermost arcing plate 15, which is designed as a shield plate, has, unlike the other plates, a front edge C bent upward and perforations 155, 156. Shield plate 15 is also secured by lateral insulating plates 148, 149. Shield plate 15 is designed to have clips 15*a*, 15*b*, projecting at a right angle from the plane of the arcing plates approximately at the center of its opposite sides. Shield plate 15 can be manufactured by punching and bending clips 15*a*, 15*b* upward. Holes 156 in bent edge C and holes 155 in the flat area are used for venting, removal of gases and pressure relief.

Figure 2:
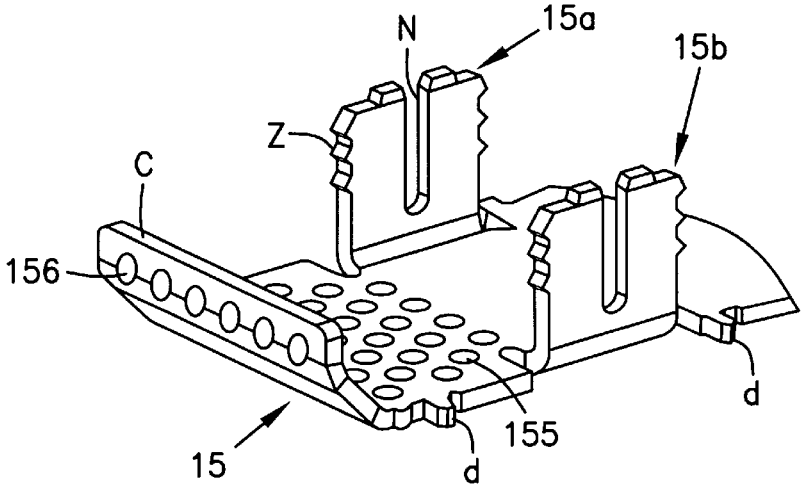
FIG. 2 shows a perspective view of the uppermost arcing plate of an arcing chamber.

FIG. 2 shows shield plate 15 in detail. The shield plate is fastened in lateral insulating plates 148, 149 via projections d arranged along its parallel sides. Clips 15*a*, 15*b* are designed as an insertion slot with groove N, the clips being designed in the shape of forks having two tines that are flexible with respect to one another. A serration Z may be formed on the outer edge of the clips.

The underside of cover 13 (FIG. 3) has six areas to accommodate a total of six arcing chambers 14, with two symmetrical rows being formed each having three such areas. Each area is designed to accommodate and secure arcing chambers 14 via pairs of lugs 15*a*, 15*b* with the corresponding recesses, i.e., pairs of recesses 131*a*, 131*b*. Corresponding to the number of interrupter chambers (six), six arcing chambers and six areas to accommodate the arcing chambers with six pairs of recesses on the underside of cover 13 are provided. Each recess, forming an insertion groove having sufficient size for the insertion of a clip, has a central ridge S on the insertion side across the recess. The diameter of central ridge S is equal to or less than the width of groove N formed in the clip, so that the clips can be inserted in the recesses via central ridge S. The width of the recesses is such that the clips can be flexibly inserted and are secured in the recesses along their serration Z.

In order to prevent the inserted clips from being guided inaccurately in the direction across the recess or from being too loose, this dimension of the recess allows easy insertion of the clips in the recesses through wedge-shaped ribs R1, R2 formed on the outside in addition to central ridges S, and at the same time the dimension of the recess decreases with the depth of insertion, so that snug positioning of the clips after insertion in the recesses is also made possible on these two opposite sides of the recesses. Thus, according to the present invention, the design of the recesses matches the dimensioning of the clips so that the latter are positioned snugly and securely on all sides of the recess and thus form a permanent positive joint, ensuring reliable and accurate positioning of the arcing chamber.

Each fastening area has an opening 132 toward the cover edge, which is used to accommodate bent edge C of the arcing chamber. Holes 156 in bent edge C form the outward venting path. Furthermore, a threaded hole 3 is formed on the side that faces opening 132 of each area for accommodating the arcing chamber, this hole corresponding to a hole 2 in shield plate 15 in order to allow arcing chamber 14 to be additionally secured to the cover via a screw.

Cover 13 and arcing chambers 14 can be pre-assembled and mounted on interrupter chamber housing 12 of the switching device as a single unit during the final assembly.

What is claimed is:

1. An electromagnetic switching device comprising:

an interrupter chamber housing including a topside facing in an upward direction and defining at least one interrupter chamber;

a cover for enclosing the at least one interrupter chamber at the topside of the at least one interrupter chamber, the cover including an underside facing opposite the upward direction and defining at least one recess in the underside;

at least one respective interrupter contact disposed in each of the at least one interrupter chamber; and a respective arcing chamber associated with each of the at least one interrupter chamber, each respective arcing chamber including a plurality of arcing plates arranged so as to form a packet, an uppermost arcing plate of the plurality of arcing plates having at least one clip projecting in the upward direction for mating with a respective recess of the at least one recess so as to form a positive-locking joint and secure the respective arcing chamber to the cover, the uppermost arcing plate facing the cover and capable of functioning as a shield plate.

2. The switching device as recited in claim 1 wherein the switching device is a high-capacity contactor.

3. The switching device as recited in claim 1 wherein each respective arcing chamber includes a de-ionization device.

4. The switching device as recited in claim 1 wherein the at least one clip includes a pair of clips projecting from a surface of the uppermost arcing plate from opposite sides of the uppermost arcing plate.

5. The switching device as recited in claim 1 wherein each of the at least one recess includes a respective central ridge across the recess and wherein each of the at least one clip defines an insertion groove therein for mating with the respective central ridge so as to aid in inserting and positioning of the at least one clip.

6. The switching device as recited in claim 1 wherein each of the at least one clip includes a plurality of serrations on at least one outer edge of the clip.

7. The switching device as recited in claim 1 wherein each of the at least one recess includes a respective central ridge across the recess and a respective projecting insertion wedge on each side of the central ridge for insertion and flexible fastening of the respective at least one clip.

8. The switching device as recited in claim 1 wherein each uppermost arcing plate defines a plurality of perforations and includes a perforated bent edge disposed at a front of the plate.

9. The switching device as recited in claim 8 wherein the at least one interrupter chamber includes six interrupter chambers and wherein the cover defines six areas in the underside of the cover, the six areas each respectively corresponding to one of the respective arcing chambers, the six areas disposed in two symmetrical rows, each area including an opening adjacent to an edge of the cover for receiving the bent edge of the respective uppermost arcing plate.

10. The switching device as recited in claim 1 wherein the cover defines at least one threaded bore hole in the underside of the cover and wherein each uppermost arcing plate defines a threaded hole corresponding to one of the at least one threaded bore hole for securing the respective arcing chamber to the cover using a respective screw.

11. The switching device as recited in claim 1 wherein each of the at least one clip is formed by a respective bent portion of the uppermost arcing plate.

12. The switching device as recited in claim 4 wherein the clips project orthogonally from a surface of the uppermost arcing plate.

13. The switching device as recited in claim 4 wherein the clips project at a middle position of the uppermost arcing plate.

* * * * *